United States Patent [19]

Mandusky et al.

[11] 3,942,777

[45] Mar. 9, 1976

[54] SEAT SPRING MEMBER

[75] Inventors: Jack C. Mandusky; Neville L. Riddle, both of Lexington, Ky.

[73] Assignee: Hoover Ball and Bearing Company, Saline, Mich.

[22] Filed: Nov. 18, 1974

[21] Appl. No.: 524,350

[52] U.S. Cl. ..... 267/102

[51] Int. Cl.[2] ..... F16F 3/02

[58] Field of Search ..... 267/102, 103, 104, 105, 267/106, 107, 108, 109, 110, 85

[56] References Cited

UNITED STATES PATENTS

| | | | |
|---|---|---|---|
| 2,835,315 | 6/1958 | Neely | 267/107 |
| 3,146,999 | 9/1964 | Stubnitz | 267/107 |
| 3,240,483 | 3/1966 | Slominski | 267/102 |
| 3,285,597 | 11/1966 | Slominski et al. | 267/107 |
| 3,288,458 | 11/1966 | Gutzman | 267/107 |

*Primary Examiner*—James B. Marbert

*Attorney, Agent, or Firm*—Olsen and Stephenson

[57] ABSTRACT

A seat spring for a seating structure having front and rear frame rails wherein the spring is constructed from a one piece wire body shaped to form a front end fishmouth portion mounted on the front rail, a yieldable rear end portion mounted on the rear frame rail and a variable length main portion extending between the front and rear portions. The fishmouth portion and the front end of the main portion are configured so that when the spring is deflected in response to a downwardly directed seating load, the spring will bottom out on the front frame rail without any wire-to-wire engagement of portions of the spring during deflection. The result is a limited deflection spring which, under shock load, will deflect without any noise.

11 Claims, 5 Drawing Figures

10
12
14
18
20
22
24
26
28
30
32
34
36
38
40
42
44
46
48
54
56
60
62
64
66
68
70
72
74
76
78
80
82
84
86
88
90
92
2
3

SEAT SPRING MEMBER

BACKGROUND OF THE INVENTION

It is customary, in seating structures having soft front edges, to construct the supporting springs with extender strips or springs which are clipped onto the main spring so that they extend upwardly and forwardly therefrom. An example of such a prior art structure is shown in U.S. Pat. No. 3,145,986. Satisfactory springs of the prior art type depend upon a secure attachment of the extender spring to the main spring, and inevitably involve wire-to-wire contact when subjected to shock loads since the wire in the extender spring will engage the wire in the main spring during deflection. Such noise is undesirable and it is also desirable from a manufacturing standpoint to be able to manufacture a soft edge spring from a single piece of wire and in a configuration in which the length and height of the spring can be readily varied during fabrication to adapt the spring to a particular size seating structure. It is an object of this invention, therefore, to provide an improved seat spring member.

SUMMARY OF THE INVENTION

The seat spring member in this invention is a limited deflection spring of variable length. It allows the necessary deflection to provide seating comfort without any attendant noise. Under shock load, the spring will bottom out on the supporting rail without any resulting wire-to-wire contact that causes objectionable noise. The spring is formed from a one piece wire body shaped to form a fishmouth front end portion mounted on a front frame rail, a rear end portion mounted on a rear frame rail and a main portion extending between the front and rear portions. The fishmouth front end portion has a lower section which is mounted at its forward end on the front frame rail and is provided with a juncture torsion bar at its rear end. The front end portion also has an upper section which extends upwardly and forwardly from the juncture torsion bar and terminates at its upper end in a mounting torsion bar. The upper section will deflect toward the lower section when the spring member is subjected to load and during deflection will move downwardly in a clearance relation with the lower section to thus avoid wire-to-wire noise.

The main portion is integral with the mounting torsion bar and extends rearwardly therefrom. The main portion includes a plurality of torsion bars and a substantially straight section which extends between a pair of the torsion bars. The main portion can be "stretched" to adapt the spring to larger seat sizes. The result is a particularly shaped one piece wire spring that provides a standard spring structure that can be manufactured for a variety of installations. To vary the height of the spring, it is only necessary to change the included angle between the upper and lower sections of the fishmouth front end portion.

In summary, therefore, it is the principal object of this invention to provide a one piece limited deflection spring of variable length and height which will provide the requisite comfort when installed in a seating structure.

Further objects, features and advantages of this invention will become apparent from a consideration of the following description, the appended claims, and the accompanying drawing in which:

Figures 1, 2, 3:
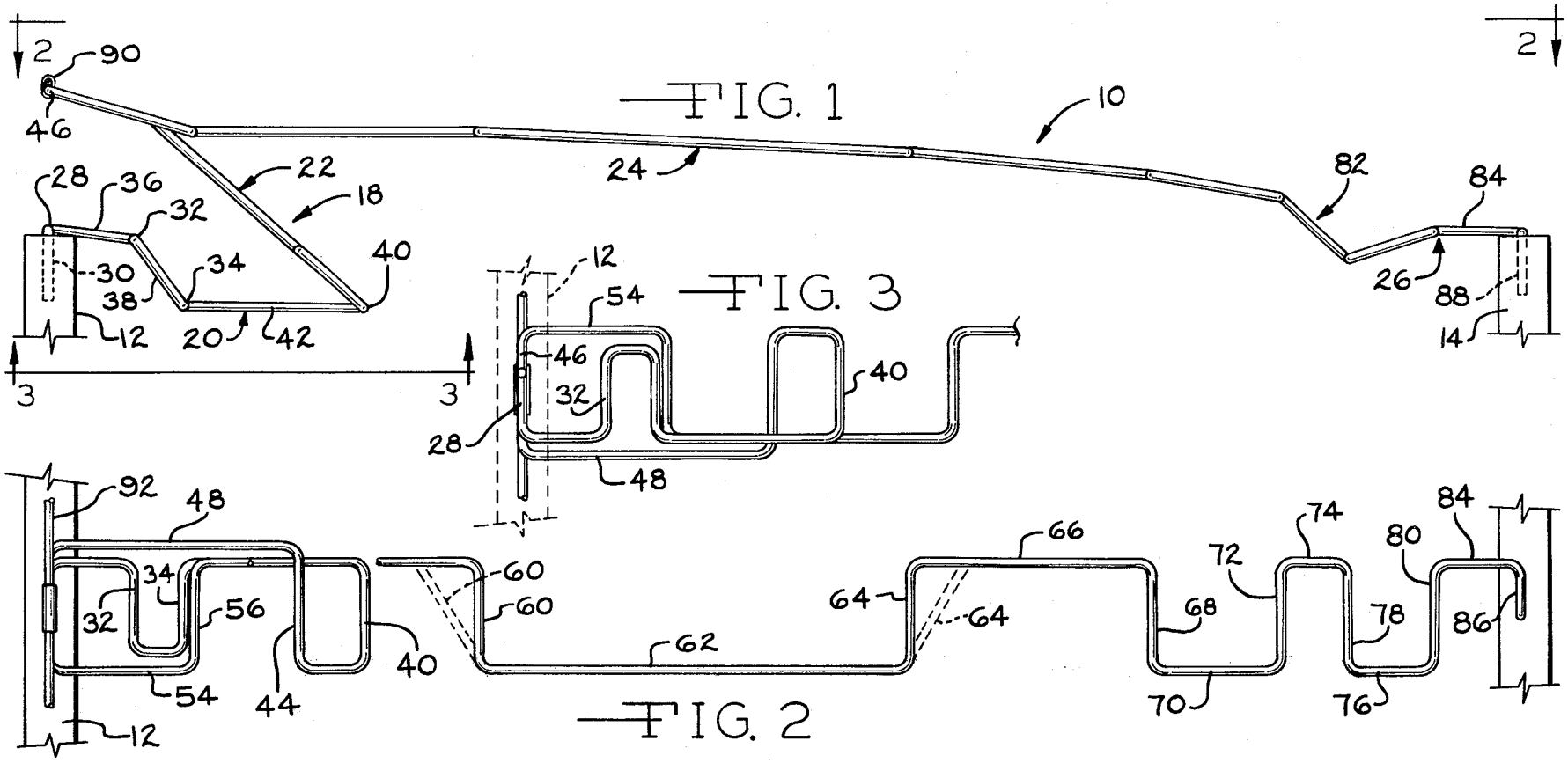
FIG. 1 is an elevational view of the spring member of this invention showing the spring member in mounted position on a pair of seating structure frame rails and showing the spring member in an undeflectd position.
FIG. 2 is a plan view of the structure shown in FIG. 1.
FIG. 3 is a fragmentary bottom view of the front end portion of the spring member of this invention, as seen substantially from the line 3—3 in FIG. 1.
Figure 5:
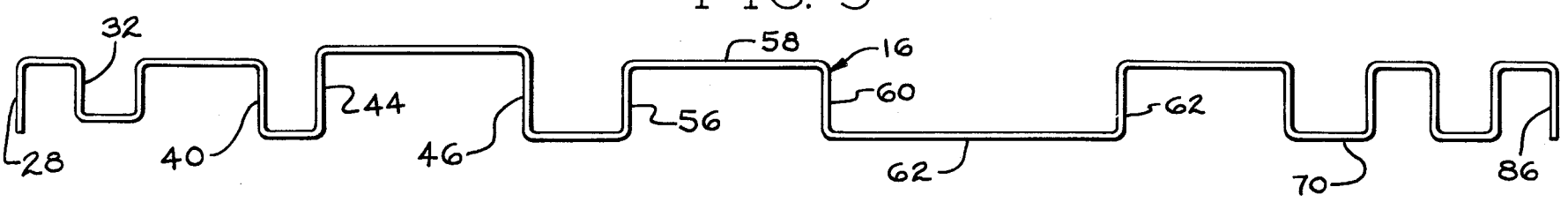
FIG. 5 is a developed view of the spring member of this invention on a reduced scale.

With reference to the drawing, the spring member of this invention, indicated generally at 10, is illustrated in FIG. 1 mounted on the front and rear frame rails 12 and 14, respectively, in a seating structure. The spring member 10 is formed from a one piece body 16 (FIG. 5) of the well known "formed wire".

The formed wire body 16 is shaped to form the spring member 10 with a fishmouth front end portion 18 having a lower section 20 and an upper section 22, a main portion 24 and a rear end portion 26. The front end lower section 20 consists of a first torsion bar 28 having an integral prong 30 that projects into the rail 12, second and third torsion bars 32 and 34 and connecting bars 36 and 38 which connect the bars 28, 32 and 34. As shown in FIG. 1, the connecting bar 36 is generally horizontal in the undeflected position of the spring. The connecting bar 38 extends downwardly and rearwardly from the bar 32.

Figure 4:
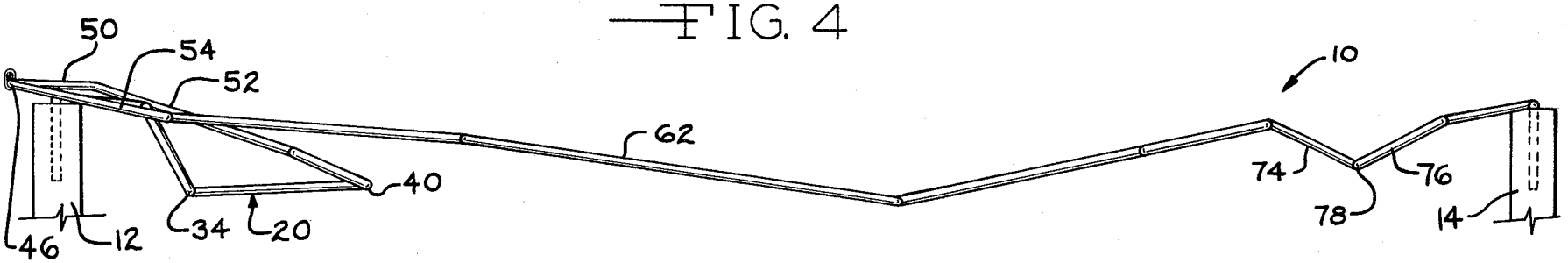
FIG. 4 is an elevational view of the spring member of this invention, illustrated in a deflected position in which the spring has bottomed out on the front frame rail.

The front end portion 18 has a torsion bar 40 located at the juncture of the lower section 20 and the upper section 22. A generally horizontal connecting bar 42 connects the torsion bars 34 and 40. The upper section 22 is provided intermediate its ends with a torsion bar 44 and terminates at its upper end in a torsion bar 46 which is hereinafter referred to as the mounting torsion bar. A connecting bar 48 which extends between the bars 44 and 46 is bent intermediate its ends so that it has two angularly related portions 50 and 52 (FIG. 4).

The main portion 24 of the spring member 10 consists of a first connecting bar 54 which is integral with one end of the mounting torsion bar 46 and extends rearwardly and downwardly therefrom, terminating at a torsion bar 56. A connecting bar 58 extends rearwardly from the torsion bar 56 and terminates in a torsion bar 60 located at one end of a straight wire section 62 of substantial length which forms a signficant portion of the length of the main portion 24. A torsion bar 64 is disposed at the rear end of the wire section 62 and is integral with a connecting bar 66 which is integral with a torsion bar 68 which is in turn connected to a connecting bar 70. A torsion bar 72 at the rear end of the connecting bar 70 cooperates with a pair of inclined connecting bars 74 and 76 and torsion bars 78 and 80 to form a generally V-shaped valve section 82 adjacent the rear frame rail 14. The rear end portion 26 of the spring 10 terminates in a connecting bar 84 and a torsion bar 86 which is integrally formed with a prong 88 that extends into the rail 14.

In the use of the spring member 10 assuming that the spring member is in the undeflected position shown in FIG. 1. When a seating load is applied to the spring member 10 it is deflected downwardly a distance which is dependent upon the magnitude of the load and the dynamic power with which the load is applied. Under heavy load or shock conditions, the spring member 10 will be deflected to the position shown in FIG. 4 in which the connecting bar 54 bottoms out on the front frame rail 12. Significantly, this bottoming out takes place without any previous wire-to-wire contact in the spring 10. This elimination of wire-to-wire contact is particularly desirable and advantageous because it positively precludes the generation of objectionable noise by movement of the spring member 10.

This objective is achieved by locating the connecting bars 48 and 54 so that they are on opposite sides of the segment of the lower spring section 20 disposed immediately therebelow as shown in FIGS. 2 and 3. This spacing of the connecting bars 48 and 54 is in turn achieved by making the mounting torsion bar 46 significantly longer than the torsion bar 28 which is pronged into the frame rail 12 and the torsion bars 32 and 34 which are adjacent the front rail 12. This is apparent from FIG. 5 which shows the mounting torsion bar 46 as being substantially longer than the torsion bars 28, 32 and 34.

As shown in FIGS. 1 and 2, the mounting torsion bar 46 is conventionally secured by a clip 90 to a conventional border wire 92. Because of the mounting of the border wire 92 on the torsion bar 46, the bar 46 is referred to herein as the "mounting torsion bar".

The downward and rearward configuration of the fishmouth lower section 20 with respect to the frame rail 12 also facilitates deflection of the main portion 24 without interference from the front fishmouth section 18. Thus, a limited deflection one piece spring member 10 is provided that is capable of imparting the necessary seating comfort and which is readily manufacturable in various sizes. The valve section 82 near the rear frame rail 14 obviates the "tail burn" problem associated with many seating structures and the fact that the straight section 62 can effectively be "stretched" enables the spring 10 to be used in seating structures in which there are varying spacings between the front rail 12 and the rear rail 14. This stretching is accomplished by exerting tensile forces on the connecting bars 58 and 66 so as to incline the torsion bars 60 and 64 at opposite ends of the connecting bar 62, as shown in borken lines in FIG. 2, to in effect increase the length of the straight section 62. Similarly, the height of the spring 10 can be varied by varying the angle between the lower and upper sections 20 and 22, respectively, in the fishmouth portion 18. One specific method for accomplishing this is to vary the magnitude of the twist in the juncture torsion bar 40.

From the above description it is seen that this invention provides a versatile limited deflection seat spring which can readily be manufactured from a single piece of wire and which will provide noise free operation. It should be noted that the portion 50 of the connecting bar 48 projects above the main portion 24 in the deflected position of the spring shown in FIG. 4. The portion 50 is substantially horizontal in this position and thus contributes directly to the seat support function. The valve section 82 adds to the firm resiliency character of the spring 10 by utilizing the resistance of the torsion bar 78 to twisting. Similarly, the torsion bar 34 and the connecting bars 38 and 42 form a valve like the valve 82 to improve the comfort characteristics of the spring 10. It should be noted that while the spring 10 is shown pronged into the frame rails 12 and 14, the spring 10 can alternatively be mounted at one or both ends on conventional mounting clips secured to the rails 12 and 14.

What is claimed is:

1. In a seat spring assembly for a seating structure having front and rear frame rails, a seat spring mounted on and extending between said frame rails, said seat spring being of one piece formed wire construction and having torsion bars arranged in an alternating relation with connecting bars, said bars being relatively arranged so that said spring has a fishmouth shape front portion comprised of a lower section which extends rearwardly from said front rail and terminates in a juncture torsion bar and an upper section which extends upwardly and forwardly from said juncture torsion bar and terminates in a mounting torsion bar, said upper section including a connecting bar formed integral with one end of said mounting torsion bar and located in a vertical plane on one side of said lower section, said spring having a main body portion which extends rearwardly from said mounting torsion bar and a rear portion mounted on said rear frame rail, said main body portion including a connecting bar formed integral with the other end of said mounting torsion bar and located in a vertical plane on the other side of said lower section so that on deflection of said spring assembly said connecting bars formed integral with said mounting torsion bar will move in a clearance relation with said lower section.

2. A seat spring assembly according to claim 1 wherein said lower section includes a first torsion bar engaged with the top side of said front rail, a second torsion bar connected to said first torsion bar and located rearwardly of said front rail and wherein said juncture bar is located rearwardly of and below said second torsion bar.

3. A seat spring assembly according to claim 2 wherein said lower section also includes a third torsion bar located between said second torsion bar and said juncture torsion bar, said third torsion bar being located below said second torsion bar and in substantially horizontal alignment with said juncture torsion bar.

4. A seat spring assembly according to claim 1 wherein said lower section has a first torsion bar mounted on said front rail, said lower section extending generally downwardly and rearwardly from said first torsion bar to said juncture torsion bar, said mounting torsion bar being of increased length relative to said first and juncture torsion bars to thereby locate said connecting bars formed integral with said mounting torsion bars in vertical planes located on opposite sides of said lower section of said fishmouth portion.

5. A seat spring assembly according to claim 4 wherein said lower section of said front end portion includes at least one torsion bar located between said first and juncture torsion bars and of a length less than the length of said mounting torsion bar, said upper section of said front end portion having an intermediate torsion bar disposed adjacent said juncture torsion bar, said intermediate torsion bar being of a length less than the length of said mounting torsion bar and greater than the length of said juncture torsion bar so that when said mounting torsion bar is moved downwardly toward said front rail, said main spring connecting bar will engage said frame rail without having first engaged said front end portion to thereby eliminate noise during deflection due to wire-to-wire engagement in said seat spring.

6. A seat spring assembly according to claim 5 wherein said main portion includes a straight wire section having torsion bars at the ends thereof, the effective length of said straight wire section being readily increased during fabrication of said seat spring by inclining the torsion bars at the ends thereof so that said torsion bars diverge in directions away from opposite ends of said straight section to adapt said spring to a particular spacing between said front and rear frame rails.

7. A seat spring member comprising a one piece wire body of formed wire construction having a plurality of torsion bars arranged in an alternating relation with connecting bars and shaped to form a spring member having a fishmouth front end portion, a rear end portion, and a main portion extending between said front and rear end portions, said fishmouth front end portion having a lower section provided with spring mounting means on the forward end thereof and a juncture torsion bar at the rear end thereof, said front end portion also having an upper section extending upwardly and forwardly from said juncture torsion bar and terminating at the upper end thereof in a mounting torsion bar, said upper section deflecting toward said lower section when said spring member is subjected to load and being movable downwardly to a position in which said mounting torsion bar is in substantial horizontal alignment with said spring mounting means, said upper section moving downwardly during said deflection in clearance relation with said lower section, said main portion being integral with said mounting torsion bar and extending rearwardly therefrom, said main portion including a plurality of transversely extending torsion bars and a substantially straight section extending between a pair of said torsion bars, and spring mounting means on the terminal end of said rear end portion.

8. In seat spring member according to claim 7 wherein said lower section of said front end portion has a segment thereof extending rearwardly from said spring mounting means located generally in a horizontal plane disposed below said mounting torsion bar.

9. A seat spring member according to claim 8 wherein said upper section and said main spring portion cooperate with said mounting torsion bar to form a portion of said spring located above and in vertical alignment with said front end segment which is wider than said segment thereby enabling downward movement past said segment to avoid wire-to-wire contact in said spring member during deflection thereof.

10. A seat spring member according to claim 7 wherein said torsion bars in said spring are of different lengths to enable said upper section of said front end portion to move downwardly in a clearance relation with said lower section and to enable said main portion to move downwardly in a clearance relation with said front end portion thereby to avoid wire-to-wire noise during deflection of said spring, said lower section having torsion bars shorter than said juncture torsion bar and said mounting torsion bar being longer than said juncture torsion bar, said upper section having an intermediate torsion bar located adjacent said juncture torsion bar and of a length greater than the length of said juncture torsion bar and less than the length of said mounting torsion bar.

11. A seat spring member according to claim 7 wherein said rear end portion includes a valve section comprising an apex torsion bar and upwardly diverging connecting bars which are formed integral with opposite ends of said apex torsion bar, said valve section being located adjacent said terminal end of said rear end portion.

* * * * *